United States Patent [19]

Engle

[11] Patent Number: 4,919,154

[45] Date of Patent: Apr. 24, 1990

[54] PIPE PURGING ASSEMBLY AND METHOD THEREFOR

[76] Inventor: Thomas B. Engle, 2135 Rosswood Dr., San Jose, Calif. 95124

[21] Appl. No.: 161,745

[22] Filed: Feb. 29, 1988

[51] Int. Cl.[5] ..... B08B 9/00; B08B 3/00

[52] U.S. Cl. ..... 134/22.12; 134/166 C; 134/169 C

[58] Field of Search ..... 134/22.12, 166 C, 169 R, 134/169 C; 137/238, 242, 244

[56] References Cited

U.S. PATENT DOCUMENTS

| | | | |
|---|---|---|---|
| 528,459 | 10/1894 | Beliveau | 134/169 C |
| 635,961 | 10/1899 | Hasson | 134/169 C |
| 1,034,301 | 7/1912 | Redeker | 134/22.12 |
| 1,215,189 | 2/1917 | Price | 134/166 C |
| 1,238,269 | 8/1917 | Cornwell | 134/169 C |
| 1,495,303 | 5/1924 | Heidelberg | 134/169 C |
| 1,532,976 | 4/1925 | Annert | 134/169 C |
| 1,861,899 | 6/1932 | Beach | 134/169 C |
| 2,147,593 | 2/1939 | Bracken | 134/166 C |
| 2,259,644 | 10/1941 | Kling | 134/22.12 |
| 2,413,997 | 1/1947 | Rosa | 134/167 C |
| 2,456,092 | 12/1948 | Storevik | 134/166 C |
| 2,608,695 | 9/1952 | Skibowski | 134/169 C |
| 2,621,668 | 12/1952 | Crispin | 134/169 C |
| 2,668,551 | 2/1954 | Clement | 134/169 C |
| 3,081,785 | 5/1963 | Lonardo | 134/169 C |
| 3,085,585 | 4/1963 | La Rocque | 134/169 C |
| 3,426,774 | 2/1969 | Conn | 134/166 C |
| 3,802,449 | 4/1974 | Mulinex | 134/166 C |
| 3,823,427 | 7/1974 | Pittet | 134/166 C |
| 3,851,342 | 12/1974 | Moore | 134/169 C |
| 3,851,352 | 12/1974 | Hibberd | 134/166 C |
| 3,879,771 | 4/1975 | Nakane | 134/166 C |
| 4,059,858 | 11/1977 | Lambel | 134/166 C |
| 4,063,317 | 12/1977 | Santore | 134/166 C |
| 4,667,691 | 5/1987 | Sasa | 134/169 C |

FOREIGN PATENT DOCUMENTS

| | | | |
|---|---|---|---|
| 1428253 | 3/1976 | United Kingdom | 134/166 C |

*Primary Examiner*—Asok Pal
*Assistant Examiner*—Ourmazd Ojan
*Attorney, Agent, or Firm*—Michael J. Hughes

[57] ABSTRACT

A pipe system purging assembly (10) is adapted for connection to a blocked pipe system (12) for the purpose of eliminating or reducing blockage therein. The preferred embodiment of the purging assembly (10) includes a internal tubing system (16) which is connected to the blocked pipe system (12) by an adaptive connector (14). A shock producing subassembly (20) then delivers rapid and repeated hydraulic shocks through the fluid into the blocked pipe system (12). Alternate subassemblies for enhancing the operation of the assembly (10) include a backpump subassembly (34), a fluid input subassembly (36) and a visual inspection subassembly (42). An inventive method of purging blockage from pipe systems is also provided with the steps of filling the isolated pipe system with fluid and delivering repeated hydraulic shocks thereto for the purposes of dislodging the blockage. Direct physical shocks may also be provided to the pipe system (12). The pipe system purging assembly (10) and the method for use thereof are particularly well adapted for use in extensive piping systems such as those found in large building complexes.

17 Claims, 3 Drawing Sheets

PIPE PURGING ASSEMBLY AND METHOD THEREFOR

TECHNICAL FIELD

The present invention relates generally to plumbing devices and more particularly to devices and methods for eliminating blockage in pipe systems.

BACKGROUND ART

Fluid piping systems are a mainstay of civilization Fluids of all natures, ranging from gases to heavy crude oil to molten metals to solid/liquid sluries are transported from one location to another through piping systems. The hydraulic and pneumatic properties of fluids within an enclosed pipe, wherein forces applied to the fluid at any point within the enclosed system are delivered to all other points within the enclosed system, make it possible for water delivery to the upper floors of high buildings and a myriad of other desirable results.

Unfortunately, one of the primary characteristics of fluid piping systems is that they are susceptible to blockage. Foreign objects can enter the system and become entrapped within the confines of the piping so as to inhibit or totally stop fluid flow through that section of the pipe. Furthermore, gradual build-up of impurities within the pipe system and the internal corrosion of the piping materials can lead to reduction of the effective flow diameter of the interior of the pipe and inhibit the free flow of fluid therethrough.

Another inherent problem with piping systems they are, by their nature, limited access systems. As anyone who has ever attempted to unclog a sewer drain or a bathroom sink drain knows, a small blockage at a point which is inaccessible from the opening can result in substantial havoc. Accordingly, inventors and artificers over the years have developed numerous methods of dealing with clogging and blockages in fluid piping systems.

One main category of declogging devices and methods utilizes a physical attack upon the source of the blockage. A common plumbers snake is a prime example of this technique. The physical attack technique has been enhanced to the extent of involving elongated flexible devices which are capable of negotiating the curves and branches of a piping system to reach the source of blockage and then to deliver physical force to dislodge it. These include the flexible rotating knife elements utilized by commercial sewer services and others.

Another common method of attempting to unclog piping systems is to apply chemical agents which tend to decompose the bonding elements in the blockage material. Commercially available caustic agents for clearing drains and sewers are prime examples of this approach.

Frequently, in piping systems where the fluid flow is substantially unidirectional, blockages may occur which are held in place by the push of the fluid and are subject to dislodgment by a reversal of the fluid flow. In these instances it is frequently effective to force fluid in the opposite direction within the piping system such that the source of blockage is dislodged backwards and broken up by turbulence. An example of this sort of approach, as applied to porous filter cakes, is found in U. S. Pat. No. 4,153,552, issued to R. M. Muther. This method uses reversible fluid flow to attempt to dislodge impurities which might become embedded in the capillaries in the filter cake and thus prevent effective fluid flow therethrough.

Depending on the nature of the blockage in the piping system and the accessibility of various points near the blockage, any of the above methods can be effective. However, far too frequently a blockage occurs in a position which is not accessible and a substantial portion of the entire system needs to be dismantled in order to remedy the problem. This is particularly common in modern large scale building complexes, such as apartment buildings, where physical inaccessibility limits the usage of physical dislodgment devices and reverse flow techniques. Furthermore, growing environmental concerns and frailty of piping systems may preclude or limit the usefulness of chemical treatment schemes. Accordingly, a great deal of room for improvement remains in the apparatus, methods and equipment adapted to reducing blockage in piping systems.

SUMMARY OF THE INVENTION

Accordingly, it is object of the present invention to provide a method for eliminating blockage within a piping system from a position remote from the point of blockage.

It is another object of the present invention to provide an apparatus for unclogging piping systems which presents no environmental threat.

It is a further object of the present invention to provide a method for unclogging piping systems which is rapid in its effect.

It is yet another object of the present invention to provide an economical method of reducing blockage and fluid flow occlusion within a piping system.

Briefly, the preferred embodiment of the present invention is a pipe purging device and method particularly adapted for use with convoluted water piping systems such as those found in modern buildings. The device and method are particularly well adapted for eliminating pipe blockages and removing internal impurity deposits (scale) from water systems such as those found in apartment complexes. In its most basic form, the preferred embodiment of the invention includes a method for coupling the external purging device to the affected pipe system in a fluid type mannér, an internal tubing system within the purging device, which tubing system includes a plurality of valves which may be opened and closed to permit or restrict fluid flow through various portions of the internal tubing system, an outlet from the internal tubing system permitting drainage of fluids from the blocked pipe system to an external location such as a drain or external point and a shock producing component which delivers hydraulic and, optionally, physical shock through the internal tubing system to the clogged pipe system so as to seismically dislodge the blockage elements and internal scale within the pipes. The preferred shock subsystem is in the form of an oscillating piston element delivering rapid and repeated hydraulic shocks to the fluid, which shocks are hydraulically transferred through the fluid to the points of blockage and/or scale formation. The rapid oscillating hydraulic shocks cause the bonding within the blockage and scale to be disrupted such that the blockage and scale breakdown into smaller components which may be flushed from the system. In one version of the preferred embodiment the shock subsystem, combined with special valving within the internal tubing system, can be operated as a back pump which permits delivery of fluid into the clogged piping system or enhances drainage therefrom.

Alternate enhanced versions of the invention include additional apparatus for monitoring and modifying the pressure components within the internal tubing system, and hence the blocked pipe system, a separate back pumping and flushing subsystem, and illuminated transparent section within the internal tubing system to permit visual inspection of the clarity of the flushed fluid, and a chemical introduction subsystem for dealing with particularly tough sources of blockage which require chemical treatment as well as hydraulic shocking for effective treatment. These alternative enhancements improve the performance of the basic system in certain types of situations.

An advantage of the present invention is that it may be contained in a simple compact apparatus which may be easily transported from one location to another.

Another advantage of the present invention is that it may be adjusted to utilize physical shocking of the clogged pipe system as well as hydraulic shocking in order to enhance dislodgment of blockage and scale.

A further advantage of the present invention is that it may be connected to blocked pipe system at points remote from and physically inaccessible to the points of blockage.

Yet another advantage of the present invention is that it substantially reduces the possible necessity of dismantlement of the pipe systems.

A still further advantage of the present invention is that it is usually effective without the necessity of inducing chemical agents into the fluid.

Yet another advantage of the present invention is that it is simple and economical to build and operate.

Still another advantage of the present invention is that the enhanced alternative embodiments are very flexible and allow multiple approaches to unclogging the pipe system.

These and other objects and advantages of the present invention will become clear to those skilled in the art upon review of the following specification and the appended claims.

BEST MODE OF CARRYING OUT THE INVENTION

The present invention is a pipe system purging assembly and method of purging pipes adapted to use hydraulic and physical shocks to dislodge blockage and scale from the interior of pipe systems. The preferred embodiment of the inventive assembly is in the form of a portable device which may be transported to the blocked pipe system and utilized on site to eliminate blockage and to reduce internal scale in the pipe system. It is expected that the primary users of the present invention will be plumbing professionals and building maintenance personnel.

Figure 1:
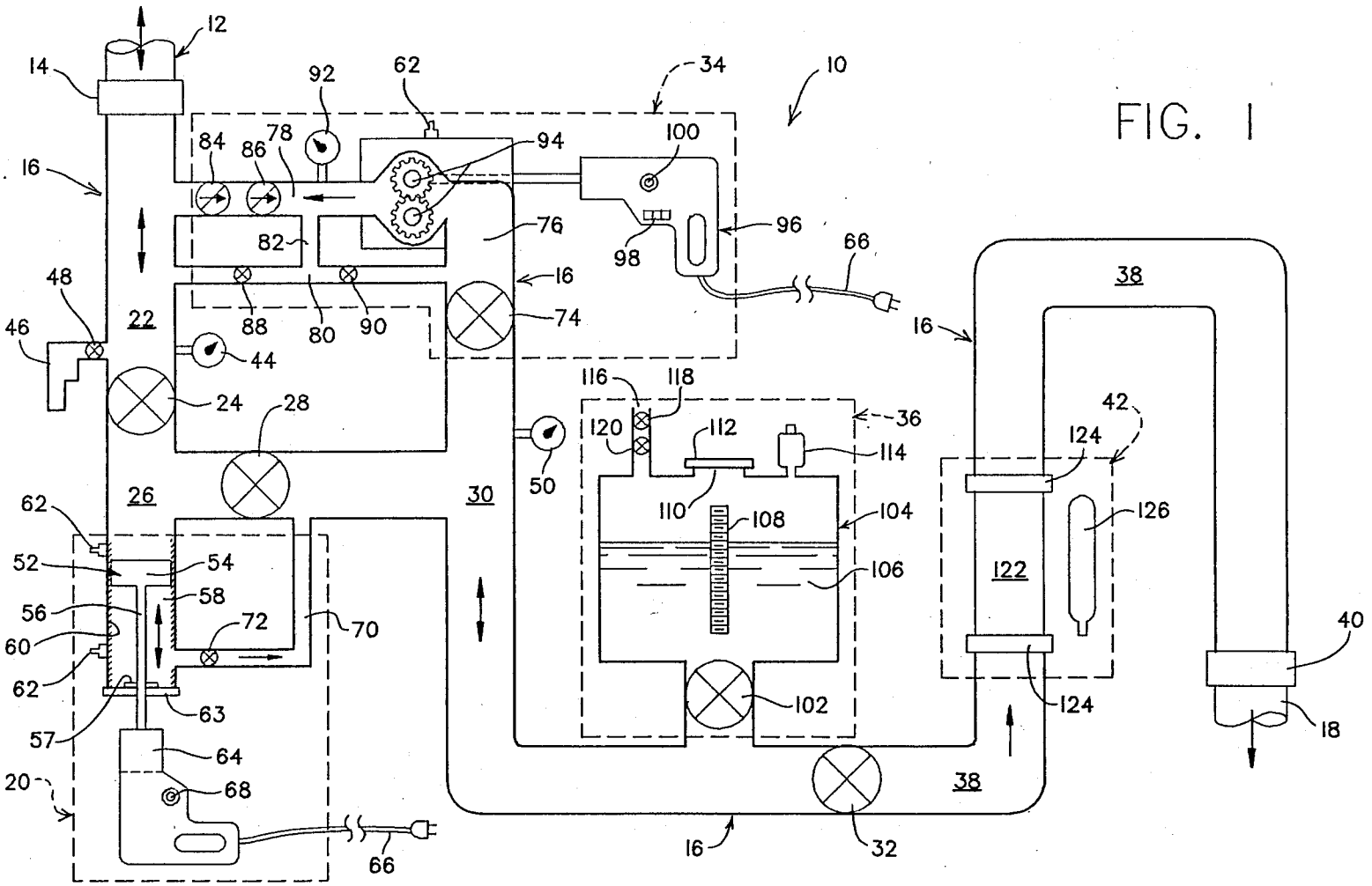
FIG. 1 is a schematic view of the preferred embodiment of the pipe purging device according to the present invention.

The preferred embodiment of the pipe system assembly of the present invention is illustrated in a schematic view in FIG. 1 and is referred to by the general reference character 10. In the illustration of FIG. 1 it may be seen that the purging assembly 10 is adapted to attach to a blocked pipe system 12 by way of an adaptive connector 14. The adaptive connector 14 causes an interface between the blocked pipe system 12 and internal tubing system 16 of the purging assembly 10. The internal tubing assembly 16 has one terminus at the adaptive connector 14 and a second terminus at a drain 18, which may be in the form of a separate drain element or may be as simple as a garden hose running outside. A shock producing subassembly 20 has operative elements situated within the internal tubing system so as to provide hydraulic shocks through the internal tubing system 16 to the blocked pipe system 12.

The internal tubing system 16 includes four distinct cavities or segments which may be isolated from one another by a variety of valve elements. The first of these is a first cavity 22 which is adjacent to the adaptive connector 14 and terminates in a first ball valve 24 which may be manually opened or closed to isolate the first cavity 22. A second cavity 26 exists between the first ball valve 24 and a second ball valve 28. The shock producing subassembly 20 is connected to the second cavity 26. In the illustration of FIG. 1, the second cavity 26 is shown as being substantially L shaped. This L shape is selected such that the shocks created by the shock producing subassembly 20 are directly in line with the first cavity 22 and the connection to the block pipe system 12. This in-line arrangement is particularly desirable when, as in the preferred embodiment, the adaptive connector 14 is selected to be a shock transmitting connector. The shock transmitting connector 14 permits physical shocks to be directly conducted to the material of the blocked pipe system 12 as well as the hydraulic shocks delivered within the fluid by the shock producing subassembly 20.

A third cavity 30 exists intermediate the second ball valve 28 and a third ball valve 32. The third cavity 30 has, as an adjunct thereto, a backpump subassembly 34 which also connects with the first cavity 22. Furthermore, the third cavity 30 also has an adjunct fluid input subassembly 36 which may be utilized to input fluid into the internal tubing system 16 from a source other than the blocked system 12.

A fourth cavity 38 exists intermediate the third ball valve 32 and a outlet connector 40 which connects the internal tubing system 16 to the drain 18. The preferred embodiment illustrated in FIG. 1 includes a visual inspection subassembly 42 included within the fourth cavity 38.

The preferred embodiment 10 also includes various mechanisms for monitoring and adjusting the internal pressure within the internal tubing system 16 and indirectly within the blocked pipe system 12. A first pressure gauge 44 is situated in connection with the first cavity 22 so as to maintain a means for monitoring the fluid pressure within the first cavity 22, which will typically be equivalent or proportional to the fluid pressure within the blocked pipe system 12. This is particularly important when the blocked pipe system 12 is completely blocked, rather than the situation where the assembly 10 is being utilized to remove scale. Since the blocked pipe systems 12 are typically older systems which may have weaknesses in the pipe material it is desirable to prevent the hydraulic pressure within the blocked pipe system 12 from reaching too high of a level. Accordingly, a relief valve 46 is provided on the first cavity 22. For most pipe systems, the relief valve 46 is selected to have a triggering pressure of approximately 150 pounds per square inch, the safe capacity of most pipe systems. However, with particular blockage problems and stronger pipe systems it is possible to close off the relief valve 46 by virtue of a relief shutoff valve 48. This allows the user to select a higher internal pressure level, if desired.

A second pressure gauge 50 is provided in the second cavity 26. The purpose of the second pressure gauge 50 is to monitor the pressure in the vicinity of the third cavity 30 in applications where fluids are to be pumped out of systems to pressurized drains.

The shock producing subassembly 20 is adapted to produce hydraulic and physical shocks to be delivered through the second cavity 26 and the first cavity 22 to the blocked pipe system 12. The primary shock producing component of the shock producing subassembly 20 is a piston 52 which includes a piston head 54 mounted on a piston shaft 56. The piston shaft 56 passes through a shaft seal 57 which effectively seals off a piston cylinder 58. A piston head 54 moves reciprocatingly within the piston cylinder 58. A lubricant 60 is provided along the sides of the piston cylinder 58 to prevent the passage of fluid into the piston cylinder 58. The lubricant is introduced into the piston cylinder 58 through a pair of lubricant serks 62, when needed.

An optional element of the shock producing subassembly 20 is a shock ring 63 which is mounted on the piston shaft 56 outside of the piston cylinder 58. The shock ring 63 is adapted to contact the end of the piston cylinder 58 at the full extent of the forward piston stroke. The shock ring 63 provides a physical shock to the internal tubing system 16 which is then delivered through the shock transmitting adaptive connector 14 to the blocked pipe system 12. In some applications it is desirable to utilize the physical shock delivered by the shock ring 63 in addition to the hydraulic shock delivered by the piston head $4 in order to dislodge the blocking material and the scale which is formed within the blocked pipe system 12.

The forward and reverse motion of the piston shaft 56 is provided by a reciprocating motor 64, such as that of a reciprocating saw such as a jigsaw. The reciprocating motor 64 provides rapid forward and reverse motion of the piston shaft 56 so as to deliver repeating hydraulic and physical shocks to the internal tubing system 16. The reciprocating motor 64 is electrically powered and receives its power through an electrical cord 66. In the preferred embodiment, the reciprocating motor 64 includes a variable speed control 68 such that the frequency of piston strokes may be adjusted by the user to the most effective frequency.

Since the seal created between the sides of the piston head 54 and the piston cylinder 58 is not perfect, even when the lubricant 60 is utilized, there is a possibility that some of the fluid will leak past the piston head 54 into the piston cylinder 58. In order to deal with this contingency a bypass line 70 is provided to connect the portion of the piston cylinder 58 behind the piston head 54 with the third cavity 30. A one way leakage relief valve 72, situated within the bypass line 70, prevents fluid from flowing back into the piston cylinder 58 from the third cavity 30.

The backpump subassembly 34 is selected to connect the third cavity 30 to the first cavity 22, bypassing the second cavity 26, which includes the shock producing subassembly 20. The backpump subassembly is utilized to deliver fluids into the blocked pipe system and also, at times, to induce a sloshing type of fluid action within the blocked pipe system 12 in order to aid in dislodging blockage or scale. The backpump subassembly 34 includes a backpump ball valve 74 which controls the flow of fluid between the third cavity 30 and a backpump cavity 76. A unidirectional flow tube 78 and an alternate flow tube so connect the backpump cavity 76 to the first cavity 22. A connector tube 82 runs between the unidirectional flow tube 78 and the alternate flow tube 80. The unidirectional flow tube 78 is provided to allow flow of fluid from the backpump cavity into the first cavity but to prevent reverse flow. The prevention is accomplished by a first one-way valve 84 and a second one way valve 86 situated within the unidirectional flow tube 78. The one way valves 84 and 86 permit flow only in the direction from the backpump cavity 76 to the first cavity 22. It is necessary to have two one way valves 84 and 86 because of a need of a back up valve in case one gets jammed with scale and will not effectively seal. This a likely occurrence in some applications so it is desirable to have a back up one way valve 86 to cover the possibility.

The alternate flow tube 80 is primarily utilized in the sloshing action mode of the backpump subassembly and is adapted so that it may be opened to permit flow in a variety of manners. The flow is controlled by a first alternate ball valve 88 and a second alternate ball valve 90. When the first alternate ball valve 88 is opened it is possible for fluid to flow from the first cavity 22 into the backpump cavity 76, either through the connector tube 82 or, if the second alternate ball valve 90 is in open position, directly through the alternate flow tube 80. The desirability of having these alternate flow paths is to bypass ball valves 88 and 90. This is useful in order to bypass a gear pump mechanism 94, thus allowing fluids to slosh back and forth when the pump 94 is shut off and on. The same effect, can be accomplished by allowing the pump 94 to run steadily while opening and closing valve 90. A third pressure gauge 92 is provided within the backpump cavity 76 in order to monitor the pressure of fluid within this cavity.

The direction and rapidity of the flow of fluid within the backpump cavity 76 is controlled by the gear pump mechanism 94. The gear pump mechanism 94 is powered by a gear pump motor 96 of a rotational type which drives the gear pump mechanism in such a manner that fluid flow is induced within the backpump cavity 76. The gear pump motor 96 is electrically powered and is connected by an electrical cord 66 to a source of electricity. For proper operation of the gear pump motor 96 is provided with a bi-directional switch 98 and a variable rotation speed control 100.

The fluid input subassembly 36 is utilized both for the purpose of filling the internal piping system and the blocked pipe system with fluid such that hydraulic shocks may be delivered and also for the purpose of introducing chemical agents and physical abrasives into the blocked pipe system if such is desired.

The fluid input subassembly 36 is connected to the third cavity 30 by way of a fluid input ball valve 102. The fluid input ball valve 102, which may be opened and closed by the user, is situated at the base of a holding tank 104. When the fluid input ball valve 102 is open the input fluid 106 contained in the holding tank 104 may flow into the third cavity 30. The user is able to monitor the level of the input fluid 106 within the holding tank 104 by way of a fluid level indicator 108, which, in the preferred embodiment, is in the form of a sight glass. Additional fluid is added to the holding tank 104 through a fill port 110 having a fill port cover 112. Excess gas escapes the holding tank 104 by way of a gas purge valve 114.

A bleed valve/gas inlet 116 is also provided at the upper end of the holding tank 104 in order to allow air to enter the holding tank 104 and thus allow input fluid to exit even when the fillport cover is tightly closed. The bleed valve/gas inlet 116 may also be used as an input source of pressurized gas to force the contents of the holding tank 104 into the internal tubing system 16. This is especially valuable when solid abrasives, such as sand, are utilized. The bleed valve/gas inlet 116 includes a bleed ball valve 118 which may be closed by the user if it is desired to prevent air input and a bleed check valve 120 which is a one way valve to prevent backflow, necessary if the holding tank 104 is to be pressurized. When a pressurized input from the input subassembly 36 is utilized the pressure may be monitored at the second pressure gauge 50.

The visual inspection subassembly 42, which is situated within the fourth cavity 38, is provided in order to allow the user to visually inspect the clarity of the effluent which is being flushed out of the blocked pipe system 12. The visual inspection subassembly primarily includes a transparent segment 122 of pipe which is attached to the remainder of the internal tubing system 16 by a pair of segment connectors 124. A lamp 126 is situated behind the transparent segment 122 such that the user is able to view an illuminated section of the effluent. When the drain fluid is clear then it may be reasonably assumed that the source of blockage has been eliminated, the removable scale has been flushed from the system, and the project is done.

Figure 2:
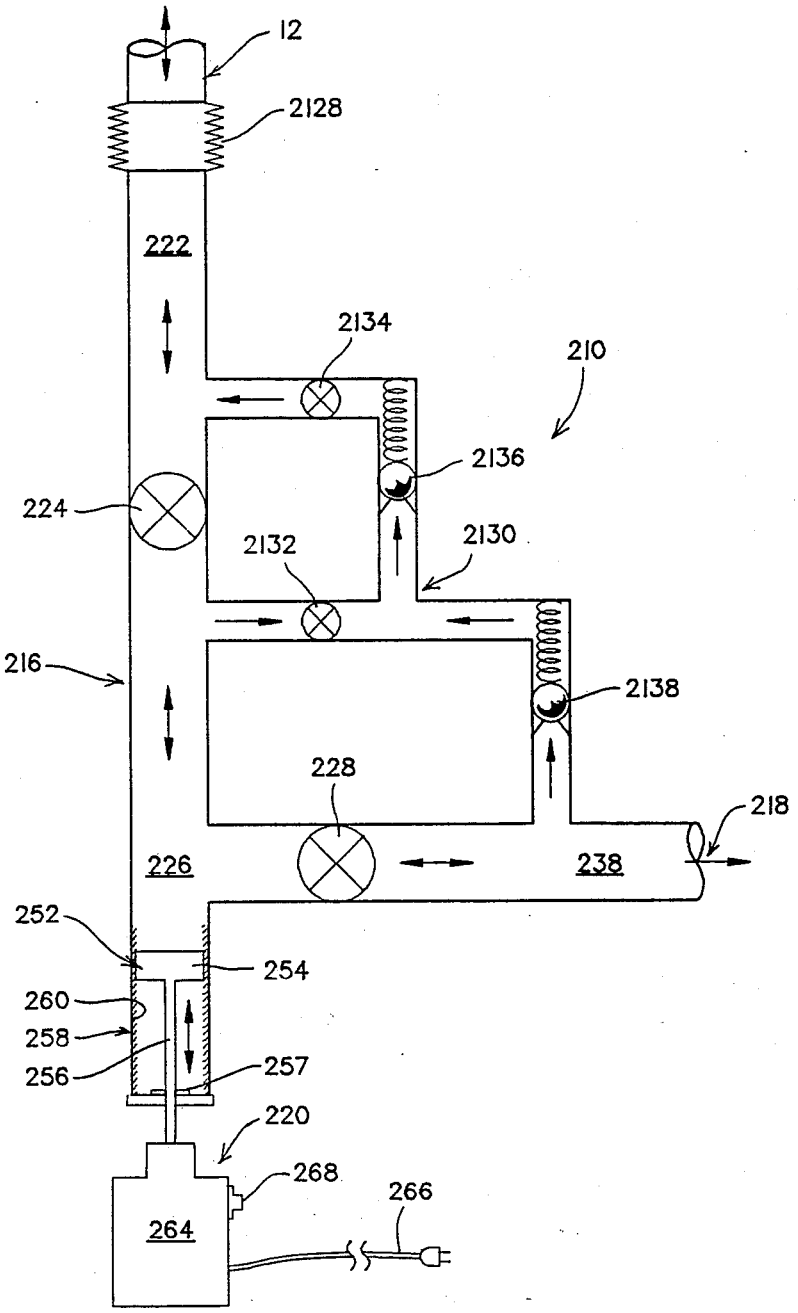
FIG. 2 is a schematic view of a minimum configuration embodiment of the present invention.

A first alternate embodiment of the pipe system purging assembly, known as the minimum configuration embodiment, is illustrated in FIG. 2 and designated by the general reference character 210. Many of the elements of the alternate embodiment 210 are common with those of the primary embodiment 10. These elements of the alternate embodiment 210 are specified by two hundred (200) series numerals. Those elements common to both embodiments will thus carry references which differ by having an initial "2" in front of the designation numeral of FIG. 1. New elements in the alternate embodiment 210 will also begin with the number "2" but will then follow with numbers continuing onward from the last element called out with respect to FIG. 1.

Similarly to the preferred embodiment 10, the alternate embodiment 210 is attached to the clogged pipe system 12 by way of an adaptive connector. In the illustration of FIG. 2 an alternate adaptive connector 2128 is illustrated. The alternate adaptive connector 2128 is selected to be a shock absorbing variety designed to prevent physical shocks from being transmitted from the purging assembly 210 to the pipe system 12. It is understood that the shock transmitting adaptive connector 14 and the shock absorbing adaptive connector 2128 may be used interchangeably with either embodiment 10 or 210 of the present invention or with many other embodiments. The illustration of the shock absorbing connector 2128 in FIG. 2 is for convenience of description. The shock absorbing connector 2128 is utilized in situations where it is not desirable to apply direct physical shocks to the pipe material in the pipe system 12. When the absorbing connector 2128 is utilized only the hydraulic shocks created by the piston assembly 220 will be translated to the sources of blockage.

In the alternate embodiment 210 the first cavity 222, the first ball valve 224, the second cavity 226 and the second ball valve 228 perform very similar functions to their counterparts in the preferred embodiment 10. Similarly, the shock producing subassembly 220 is of similar construction and operation. Since the shock absorbing adaptive connector 2128 is utilized in this embodiment there is no physical shock ring 63 provided on the alternate piston shaft 256. In the preferred embodiment 10 the shock ring 63 may be removed if it is desired to use a shock absOrbing connector 2128 therewith.

One of the primary differences between the preferred embodiment 10 and the minimum configuration embodiment 210 is that there is no direct equivalent to the third cavity 30. Beyond the alternate second ball valve 228, the internal tubing system 216 continues directly to the equivalent of the fourth cavity 238 which connects to the drain 218. The backpump capacity inherent in the backpump subassembly 34 is accomplished in a different manner in the minimum configuration embodiment 210. An alternate backpump pathway 2130 is provided which interconnects the first cavity 222, the second cavity 226 and the fourth cavity 238. The alternate backpump pathway 2130 is utilized with the shock producing subassembly 20 operating as the pump mechanism, replacing the gear pump mechanism 94 of the preferred embodiment 10.

Access to the backpump pathway 2130 is controlled by a first pathway ball valve 2132 and a second pathway ball valve 2134, each of which may be opened or closed at the user's discretion. A first ball check valve 2136 and a second ball check valve 2138 cause the fluid flow within the backpump pathway 2138 to be unidirectional. The ball check valves 2136 and 2138 are spring loaded such that they allow flow in the direction toward the spring, upon sufficient pressure, but block any flow in the opposite direction. The operation of the alternate embodiment 210 is described hereinafter with respect to FIG. 3.

Figure 3:
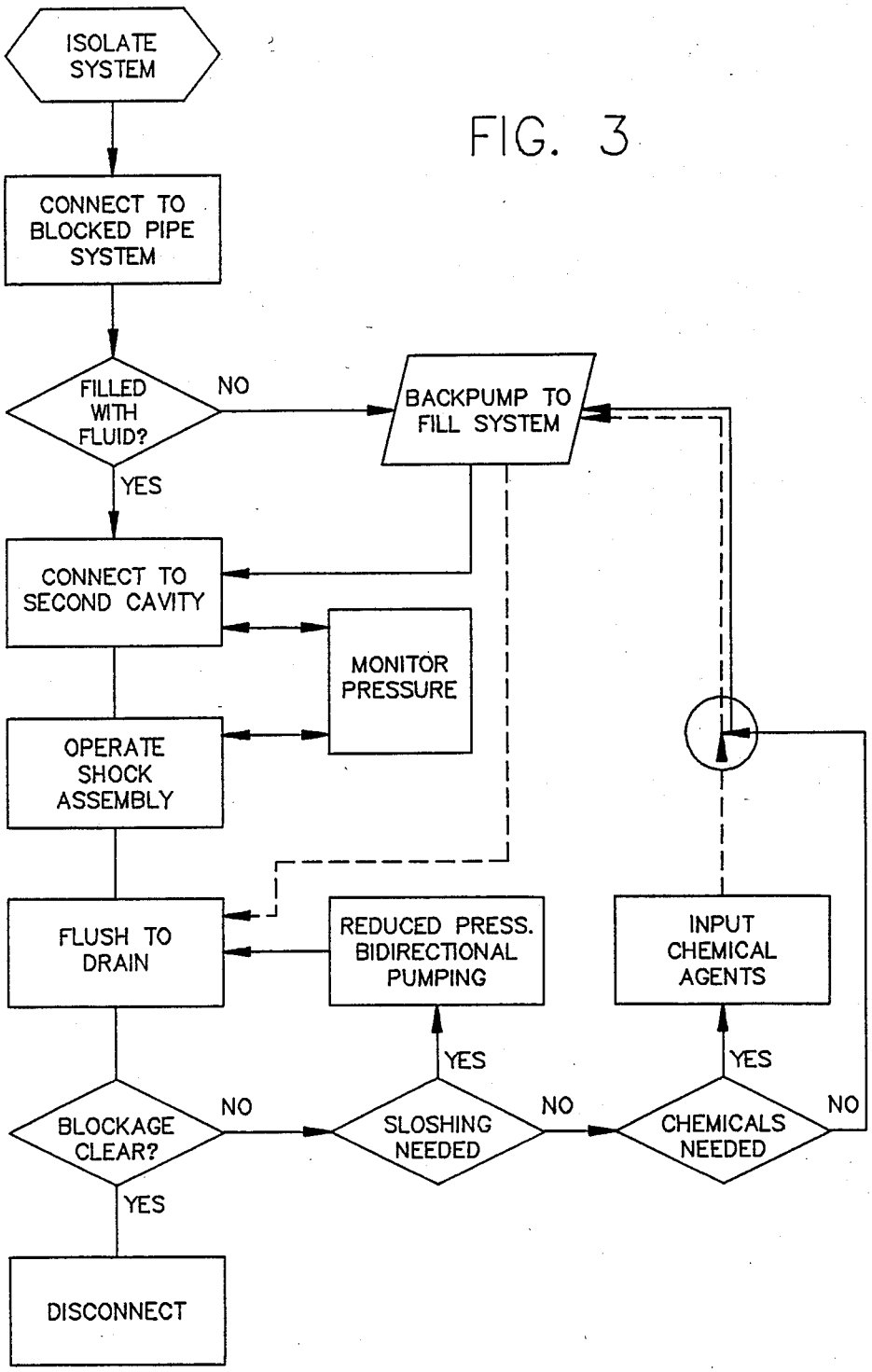
FIG. 3 is a block diagram illustrating the method of the present invention to achieve unclogging and purging of a pipe system.

The method of clearing blockage and scale from pipe systems according to the present invention is illustrated in a flow chart manner in FIG. 3. The flow chart of FIG. 3 illustrates the manner in which devices such as the preferred embodiment of the pipe system purging assembly 10 and the minimum configuration assembly 210 may be utilized to reduce and eliminate blockage within pipe systems.

As shown in FIG. 3, the initial required step is to isolate the system such that the effect of the method is only upon the blocked portion of the piping system 12 and does not result in unwanted side effects. This is usually accomplished by closing valves within the piping system such that the backflush pressure or the shocking action does not result in overflowing toilets, spouting drain pipes or similar problems.

The pipe system purging assembly 10 is prepared in advance by closing all of the ball-valves 24, 28, 32, 74, 88, 90 and 102 such that each cavity is effectively isolated. Thus, when the adaptive connector 14 is attached to the pipe system 12, fluid from the pipe system 12 can flow only into the first cavity 22. The outlet connector 40 may be attached to the drain 18 at any time during the operation prior to opening the third ball valve 32. In the initial state, the reciprocating motor 64 and the gear pump motor 96 are turned off, or unplugged, depending on the switching mechanisms. The lamp 126 is also off.

Once the isolation of the system has occurred it is then necessary to connect the blocked pipe system 12 to the purging assembly 10. This may be accomplished either utilizing a shock transmitting adaptive connector 14, in the event that the pipe system 12 is sufficiently strong to withstand physical shocks or, with regard to weaker pipe systems 12 by utilizing a shock absorbing adaptive connector 2128.

The next step is to determine whether the pipe system 12 and the operative portions of the internal tubing system 16 are filled with fluid. Obviously, if a complete fluid pathway does not exist between the assembly 10 and the pipe system 12 there is no means by which to transfer hydraulic shocks. Air bubbles can act to absorb the shocks and prevent effective delivery to the blockage location. Therefore it is desirable to ascertain that a complete liquid hydraulic pathway exists from the assembly 10 to the blockage source within the pipe system 12. If the system 12 is not already filled with fluid to sufficient density, then it is desirable to backpump fluid into the system in order to fill the cavities completely. With the preferred embodiment 10, this may be accomplished by filling the fluid input tank 104. The fluid is then pumped into the pipe system by opening the backpump ball valve 74 and activating the gear pump motor 96 to pump the water from the third cavity 30 through the backpump cavity 76 and the one way valves 84 and 86 to deliver the fluid into the pipe system 12.

Once the pipe system 12 and the first cavity 22 have been filled with sufficient fluid to the desired pressure level, as indicated on first pressure gauge 44, the second cavity is then connected by opening first ball valve 24. Pressure is maintained by further backpumping, if necessary, and the backpump ball valve 74 and the fluid input ball valve 102 are then closed. The user will monitor the pressure in the first cavity 22, which is equivalent to the pressure in the pipe system 12, to make sure that the proper pressure level is maintained.

The primary step of the process is then performed by activating the reciprocating motor 94 and utilizing the piston mechanism 52 to deliver rapid repeated hydraulic shocks to the fluid within the second cavity 26. These shocks are then transmitted by hydraulic force transmission characteristics through the fluid in the first cavity 22 and the pipe system 12 to the source of blockage. The slamming shocks delivered by the piston head 54, for best operation, have been determined to be a frequency of approximately five (5) to seven (7) strokes per second. The pressure differential created in the pipe system 12 is dependent upon the length of stroke of the piston shaft 56 so it is important to determine the effect of the piston stroke on the pressure as indicated by first pressure gauge 44. If the pressure exceeds the desirable maximum for the pipe system then it is necessary to drain some of the fluid or utilize a reciprocating motor having a shorter piston stroke. Additionally, the pressure relief valve 46 may be utilized to make certain that excess pressure does not build up.

The slam shocks provided by the shock subassembly 20 are continued for a period of time determined empirically by the user. Typically one to three minutes is a sufficient shock period. The user may be able to determine that the blockage has been dislodged by a rapid reduction of internal pressure as shown on the first pressure gauge 44.

After the reciprocating motor 64 has been turned off it is then desirable to flush the system to determine the degree of blockage and scale removal. This is accomplished by opening the second ball valve 28 and the third ball valve 32 so that the fluid may flow directly all the way through the internal piping system 16 from the pipe system 12 to the drain 18. In the preferred embodiment 10 it is desirable to inspect the clarity of the effluent at this point by activating the lamp 126 and observing the fluid as it flows through the transparent segment 122. In order to enhance the flushing it may be desirable to open a valve somewhere within the pipe system 12 to input additional fluid into the pipe system which will drain through the assembly 10 to the drain 18.

If the blockage is clear to the satisfaction of the user then the process is completed and all that is necessary is to disconnect the pipe purginq assembly 10 from the pipe system 12, which is then ready for normal operation. However, if the blockage has not been cleared by the shocking action then the user faces a series of determinations as to what the next step will be to effectuate the purging operation.

The first question to be answered as to whether it appears desirable to utilize a sloshing technique to attempt to clear deposits and blockage from the pipe system 12. This sort of action is particularly desirable when releasing partially loosened scale or some types, of blockage which can be loosened by gradual low pressure sloshing rather than the direct shock technique. To accomplishing sloshing, a certain amount of fluid is backpumped into the system 12 as described above but the pressure is maintained at a much lower level so that fluid flow back and forth is accomplished without impedance. Then the gear pump motor 96 is utilized in rapid reverse pump mode by repeatedly switching the bi-directional switch 96 from forward pumping to reverse pumping and back again. In order for this operation to be effective it is usually desirable to close the backpump valve 74 and open the alternate ball valves 88 and 90, or at least ball valve 88.

Once the desired amount of sloshing has been completed it is then necessary to again flush to the drain and to determine whether the blockage has been cleared to users satisfaction. The user then determines whether further sloshing is needed or whether additional steps may be required.

A further additional step which may be desired is the addition of chemicals or abrasives to the pipe system 12 in order to attempt to dissolve or otherwise break up the blockage. This may be accomplished by filling the input tank 104 with a chemical mixture desired for the particular application or an abrasive slurry using particles such as grains of sand and backpumping to fill the system with the chemical agent or abrasive in the same manner in which backpumping is accomplished to create the proper pressure level. In the event that the chemical agent may be caustic to the shock producing subassembly 20 it may be desirable to directly drain the system after the chemical treatment rather than operating the shock subassembly 20 with the chemical in place. However, there may be instances in which it is desirable to actually shock the system while the chemical agent is present in the fluid medium.

Of course, if neither sloshing nor chemicals are viewed as being desirable or needed at a particular stage but the blockage has not yet been cleared it is possible to again backpump to fill the system and repeat the shocking steps. These may be repeated as many times as necessary to clear the blockage. The various other steps may also be repeated as necessary.

When the minimum configuration embodiment 210 is utilized the procedures will be substantially similar except that the alternate operations of visual inspection of the effluent at a portion of the assembly 210 itself and the introduction of chemical agents are not directly available through the apparatus 210. The backpumping step is also accomplished by a different mechanism. In the case of the alternate embodiment 210 backpumping is accomplished by closing the first ball valve 224 and the second ball valve 228 and opening the first pathway ball valve 2132 and the second pathway ball valve 2134. The piston mechanism 252 is then utilized as a pump by the modification of operating it at a slower speed such that the ball check valve 2136 and 2138 may properly function to permit fluid flow therethrough in the direction of the blocked pipe system 12. Whereas the shocking operational speed of the reciprocating motor 264 is typically in the range of five (5) to seven (7) oscillations per second, the pumping speed is approximately two (2) oscillations per second. A source of fluid will also need to be provided from the direction of the drain 218 in order to permit appropriate backpumping.

The components utilized to construct the apparatus of the present invention are conventional off-the-shelf items available to plumbers. No special tooling or custom manufactured items are required. The reciprocating motor 64 may be any of a variety selected by the particular user, although the inventor, has found that a reciprocating saw motor is quite effective. Similarly, a bi-directional variable speed drill motor has been found appropriate as the gear pump motor 96. The dimensions and materials of the internal tubing system 16 are entirely at the discretion of the user. The illustrations of FIG. 1 and FIG. 2 show varying diameters of portions of the internal tubing system 16, but these are not critical to operation.

Those skilled in the art will readily observe that numerous modifications and alterations of the present invention may be made while retaining the teachings thereof. Accordingly, the above disclosure is not intended at limiting. The appended claims are therefore to be interpreted as encompassing the entire spirit and scope of the invention.

INDUSTRIAL APPLICABILITY

The pipe system purging assembly 10 according to the present invention, and various alternate embodiments thereof, are particularly well adapted for utilization in eliminating blockage and formed deposits within piping systems. The apparatus and method of the invention are especially adapted for eliminating blockages in locations which are inaccessible by other methods. A primary utilization of the present invention is in clearing water piping lines in large buildings such as apartment complexes.

The pipe purging apparatus 10 is particularly useful in that it may be enclosed in a single transportable apparatus which may be handled by a single person and transported to the source of the problem. A variety of adaptive connectors 14 may be utilized allowing the assembly 10 to be connected to any type of piping. The only requirements for operation are the availability of electricity and accessibility to the internal piping system 12.

The assembly and method of the present invention effective in rapidly reducing or eliminating blockage in piping systems in an inexpensive manner. The invention has been shown to have a very high degree of success in situations which would otherwise require expensive and time consuming dismantling of the blocked pipe system 12. By using the assembly and method of the present invention a single operator may cure any problem which had in the past required several person-days of labor.

For all of the above and other reasons, it is expected that the pipe system purging assembly 10 and the pipe purging method of the present invention will have widespread industrial applicability. Plumbing professionals and building maintenance personnel will find the invention of particularly substantial value. Therefore, it is expected that the commercial utility of the present invention will be very substantial.

What is claimed is:

1. A pipe purging assembly for purging fluid flow blockage from pipe systems comprising:

coupling means for attaching the assembly to the blocked pipe system such that fluid may flow freely between the device and the pipe system;

an internal tubing system within the assembly including at least serially connected first, second, third and fourth cavities, each of which is isolatible by way of user controllable valves, the tubing system culminating at one end thereof with the coupling means and culminating at the other end thereof in outlet means for permitting fluid to flow therethrough out of the device to a destination separate from the blocked pipe system; and a hydraulic shock producing subassembly attached to the tubing system for delivering repeated controlled hydraulic shocks to fluid contained within the tubing system; wherein a backpump subassembly is provided to interconnect said third cavity to said first cavity, bypassing said second cavity, said backpump subassembly being utilized to pump fluid into the pipe system.

2. The pipe purging assembly of claim 1 wherein said first cavity is adjacent to the coupling means, said second cavity includes the connection to the hydraulic shock producing subassembly and said fourth cavity is connected to said outlet means.

3. The pipe purging assembly of claim 2 wherein:

the hydraulic shock producing subassembly, at least a portion of said second cavity, and said first cavity are linearly aligned such that shocks produced are linearly translated therethrough to the pipe system.

4. The pipe purging assembly of claim 1 wherein:

a fluid input subassembly is attached to said third cavity, said fluid input subassembly being adapted to introduce fluid into said third cavity such that said fluid may be pumped into the pipe system by said backpump subassembly.

5. The pipe purging assembly of claim 4 wherein said fluid input subassembly includes:

a holding tank, user operable valve means intermediate said holding tank and said third cavity, fill means for introducing fluid into said holding tank, and fluid level indicator means for indicating the fluid level within said holding tank.

6. The pipe purging assembly of claim 5 wherein said fluid input subassembly further includes:

gas purge means for allowing the escape of gases from said holding tank and pressurizing means for creating an enhanced internal pressure within said holding tank.

7. The pipe purging assembly of claim 1 wherein said backpump subassembly includes:

a bi-directional, variable speed pump device, a convoluted pathway structure, and unidirectional and user operable valves within said pathway structure to facilitate pumping of said fluid.

8. The pipe purging assembly of claim 1 wherein the hydraulic shock producing subassembly includes:

piston means in direct contact with an unbroken hydraulic pathway intermediate said piston means and the blockage; and reciprocating drive means for driving said piston means so as to produce said hydraulic shocks.

9. The pipe purging assembly of claim 3 wherein the hydraulic shock producing subassembly includes:

a piston cylinder interconnected with and forming a part of said second cavity;

a piston having a piston head, adapted to axially slide within said piston cylinder, and a piston shaft;

lubricating seal means to facilitate the sliding of said piston head within said piston cylinder while inhibiting the passage of matter between the circumferential edges of said piston head and said piston cylinder; and reciprocating drive means attached to said piston shaft so as to drive said piston head in an axial fashion to produce said hydraulic shocks.

10. The pipe purging assembly of claim 9 wherein:

said piston is further provided with a shock ring attached to said piston shaft, said shock ring being adapted to deliver a physical shock to said piston cylinder, said physical shock being transmitted through the internal tubing system to the coupling means; and the coupling means is selected to be shock transmitting in nature so as to deliver said physical shocks to the structure of the pipe system.

11. The pipe purging assembly of claim 1 wherein:

the coupling means is selected to be physically shock absorbing in nature such that only said hydraulic shocks are delivered to the pipe system.

12. The pipe purging assembly of claim 1 wherein:

visual inspection means are provided within the internal tubing system such that the user may evaluate the clarity of effluent flowing from the pipe system to said outlet means, and to thereby determine the degree to which blockage has been purged from the pipe system.

13. An assembly for loosening blockage and deposits in piping systems, comprising:

an internal tubing system within the assembly having at least first, second and third cavities, each of which is isolatible by way of user controllable valves; wherein at least two uninterrupted hydraulic pathways exist;

piston means for impacting fluid within the piping system, said fluid completely filling an enclosed volume including the forward surface of the piston means and said blockage and deposits;

reciprocating power means for rapidly and repeatedly driving the piston means so as to deliver hydraulic shocks to said fluid, said reciprocating means also being adapted to function as a back pump means for filling said enclosed volume with fluid.

14. The assembly of claim 13 wherein the piston means includes:

a piston cylinder having a hollow interior;

a piston head adapted to slidably fit within said piston cylinder;

lubrication for peripherally surrounding said piston head so as to facilitate sliding within said cylinder while precluding fluid flow thereabout; and a piston shaft connecting said piston head to said reciprocating power means.

15. The assembly of claim 13 wherein the reciprocating power means includes:

a reciprocating electrical motor being adjustable to operate over a range of oscillation frequencies; and an electrical source for providing power to said motor.

16. A method of clearing flow inhibiting impediments from the interior of a fluid piping system, in steps comprising:

A. isolating the impediments within an enclosed volume within the piping system;

B. connecting a shock producing pipe purging assembly, including an internal tubing system having at least first, second, third and fourth cavities, each of which is isolatable by way of user controllable values, to said enclosed volume;

C. filling said enclosed volume with fluid such that an uninterrupted hydraulic pathway exists from said shock producing pipe purging assembly throughout said enclosed volume;

D. actuating said shock producing pipe purging assembly so as to deliver rapid repeated hydraulic shocks to said hydraulic pathway for a selected period of time;

E. draining said enclosed volume of said fluid;

F. partially filling said enclosed volume and said internal tubing system with said fluid and activating a bidirectional pump mechanism in alternating directions so as to slosh said fluid back and forth within said enclosed volume.

G. determining whether the impediments have been cleared and, if not, repeating steps C., D., E. and F. until clearance has been accomplished; and H. disconnecting said shock producing pipe purging assembly and reversing said isolation of said enclosed volume.

17. The method of claim 16 and including the additional step of:

E2. introducing chemical and/or abrasive agents into said enclosed volume to attack the impediments for a selected period of time.

* * * * *